US006023910A

United States Patent [19]

Lubus et al.

[11] Patent Number: 6,023,910

[45] Date of Patent: Feb. 15, 2000

[54] CAPPING MACHINE

[75] Inventors: Samuel J. Lubus, Osprey; John W. Carlson, Nokomis, both of Fla.

[73] Assignee: Inline Filling Systems, Inc., Venice, Fla.

[21] Appl. No.: 09/141,506

[22] Filed: Aug. 28, 1998

[51] Int. Cl.[7] ..... B65B 3/20; B65B 7/28

[52] U.S. Cl. ..... 53/317; 53/331.5

[58] Field of Search ..... 53/306, 314, 315, 53/317, 331.5

[56] References Cited

U.S. PATENT DOCUMENTS 3,054,234 9/1962 Stover ..... 53/317
3,280,534 10/1966 Hildebrandt ..... 53/331.5
4,199,914 4/1980 Ochs et al. ..... 53/317
5,007,228 4/1991 Herzog ..... 53/331.5

*Primary Examiner*—John Sipos
*Attorney, Agent, or Firm*—Gifford, Krass, Groh, Sprinkle, Anderson & Citkowski, P.C.

[57] ABSTRACT

A machine for attaching threaded caps to containers continuously moving in a longitudinal path and having endless belts disposed at opposite sides of the caps with the cap engaging belt portions traveling in opposite directions to impart twisting motion to the cap. The belts are moved transversely of the path into and out of engagement with the caps at a uniformed but variable rate to impose two or more pulses of twisting movement to each cap. The times of engagement and disengagement of the belts with the caps, the maximum twisting force and speed of the belts all are under the control of a programmable logic controller.

14 Claims, 7 Drawing Sheets

CAPPING MACHINE

BACKGROUND OF THE INVENTION

1. Field of the Invention

This invention relates to machines for filling containers and applying caps to close the containers, and more specifically, to inline filling and capping machines where threaded caps are applied to continuously moving containers.

2. Summary of the Invention

Variations in the configurations of containers and closures, in the contents of the containers and in the operation of the closures must all be accommodated for successful high speed filling and capping operations. Capping has usually been accomplished by either chuck-type capping machines in which the caps are grasped and twisted onto a filled container, or by capping machines employing multiple pairs of rotating discs which engage opposite sides of a cap and twist it in a closing direction. Chuck-type capping machines require a different chuck for each size of cap which can be costly to use if many sizes of caps are processed because of the storage of the chucks and the time required for installation and adjustment. Disc-type capping machines require multiple arrangement of disc drives which are costly to acquire, maintain and adjust.

It is an object of the invention to provide a capping machine in which caps are twisted to a closed position by belts engaging opposite sides of the cap.

It is a further object of the invention to provide a capping machine which employs cap engaging belts to exert a twisting force to apply caps to filled containers continuously at a high rate of speed. a cap by regulating the speed and time of contact and release of belts with the cap with such variables being adjustable without interrupting movement of the filling and capping line.

Another object of the invention is to provide a capping machine that will accommodate an infinite variety of cap shapes and materials with the associated variations in closing force requirements.

The objects of the invention are accomplished by a programmable capping machine in which caps are delivered to continuously moving containers after they have been filled to place the caps on top of the containers where they are engaged by the capping machine to apply a twisting action to move the caps to a closed position. This is all accomplished at a very high rate of speed, to the order of 200 containers per minute. The capping action is accomplished by employing a pair of belts having adjacent flights engaging opposite sides of the caps with the flights traveling in opposite directions to twist the caps to a closed position. The twisting action of the belts is modified by oscillating load applying and releasing shoes into engagement with the belts to move the cap engaging flights into and out of engagement with the caps. In addition to the speed of the belts, the duration of belt engagement with the caps and the duration of the release of the belts from the caps are programmable so that a wide variety of conditions can be accommodated. Also, the maximum torque that can be applied to a cap is regulated by a clutch which is adjustable and programmable.

DETAILED DESCRIPTION OF THE PREFERRED EMBODIMENT

Figure 2:
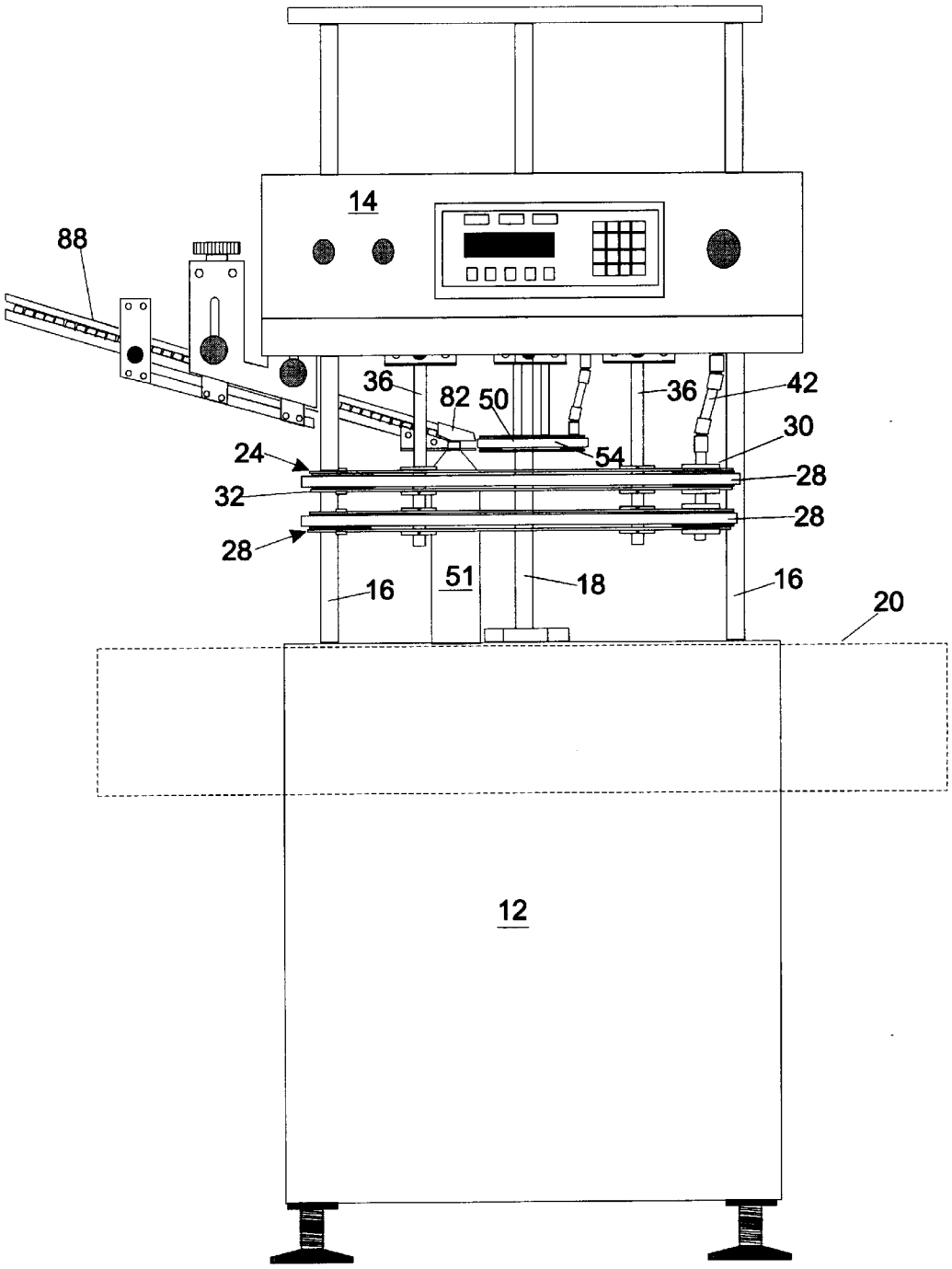
FIG. 2 is a front elevation of a portion of the apparatus seen in FIG. 1 with the container conveyor indicated in dotted line.

A filling and capping machine embodying the present invention is designated generally at 10 and includes a base member 12 which supports a control head 14 in elevated position above the base member 12 for vertical sliding movement on guide or support posts 16 extending from the base 12 and in response to actuation of a threaded jack member 18 disposed between the base 12 and the head 14. The head 14 has a portion that is cantilevered to one side of the base 12, as seen in FIG. 2, to be positioned in elevated position over a container conveyer 20 of an inline filling and capping line.

Figure 1:
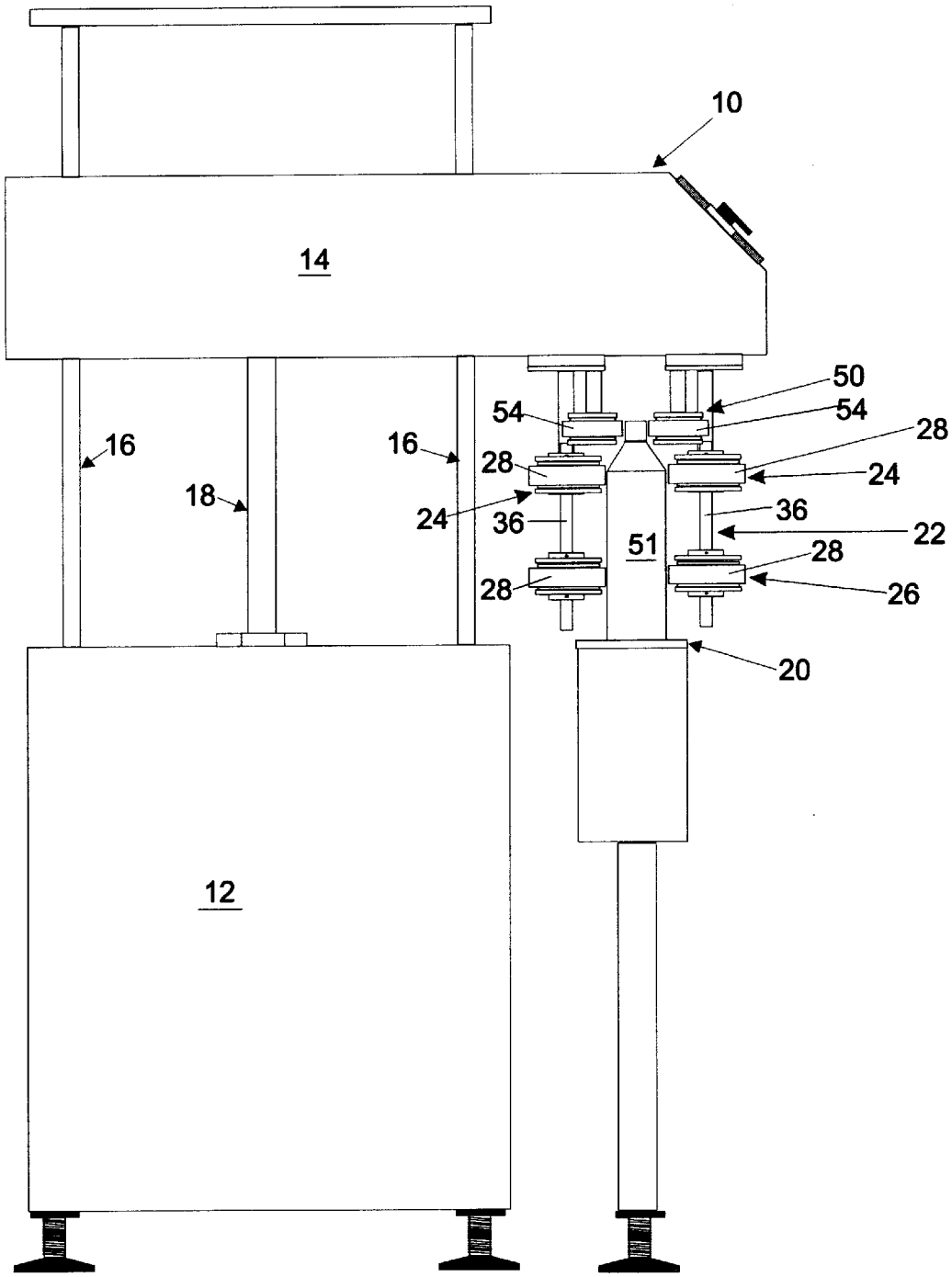
FIG. 1 is an end view of a machine incorporating the capping apparatus of the present invention.
Figure 3:
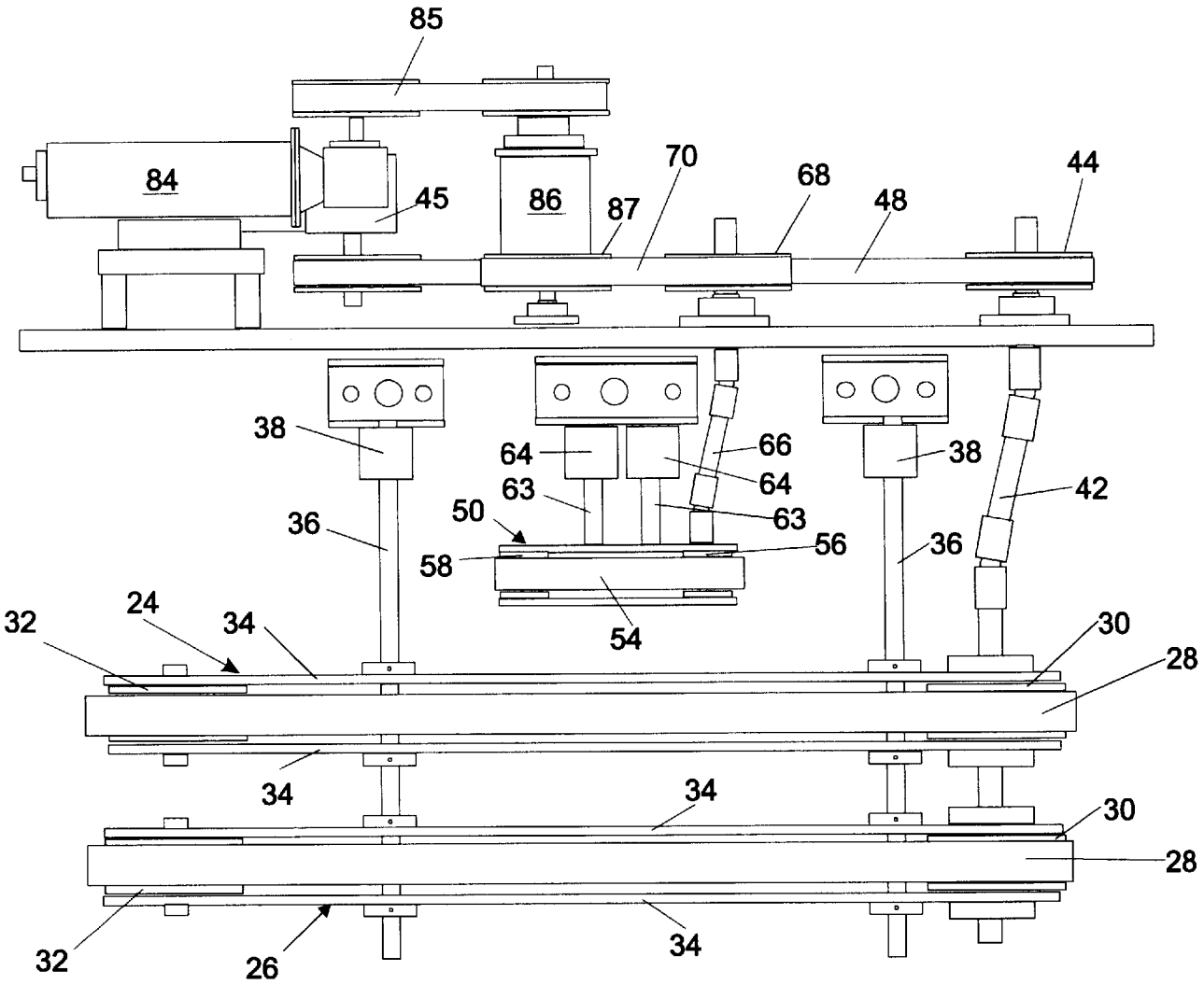
FIG. 3 is a front elevation at an enlarged scale of the drive mechanism for the capping apparatus.
Figure 6:
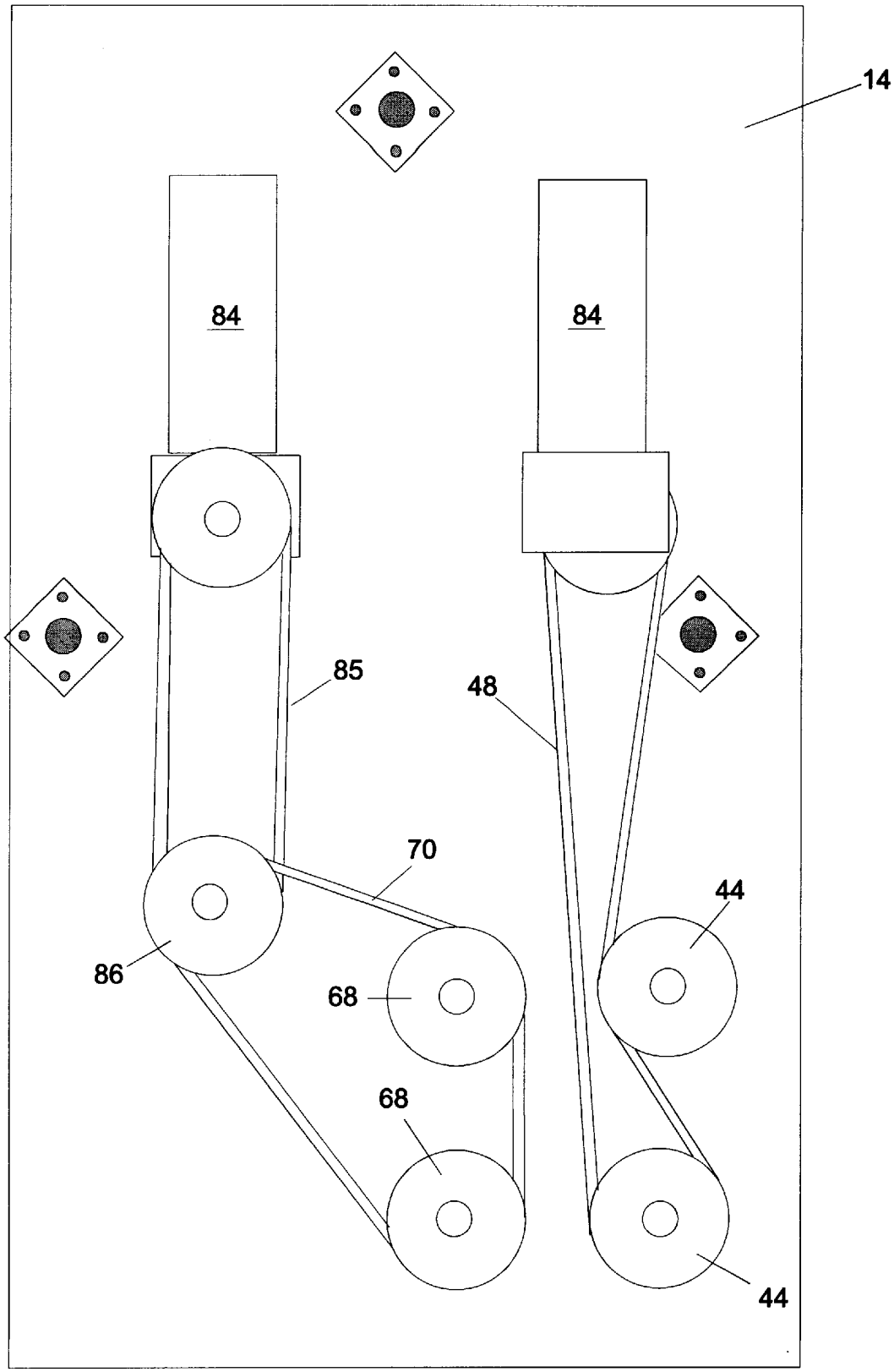
FIG. 6 is a diagrammatic plan view showing the drive arrangement for the capping apparatus.

A container gripper mechanism designated generally at 22 depends from the control head 14. The mechanism 22 includes a pair of upper belt gripper assemblies 24 and if desired a pair of lower gripper belt assemblies 26 disposed at opposite sides of the conveyor 20 which forms the path of movement of the containers in the filling machine 10. As seen in FIG. 6, each of the gripper assemblies 24 and 26 includes a container engaging belt 28 trained over a drive pulley 30 and an idler pulley 32 supported for rotation on vertical axes from a frame member 34 so that the container engaging belts 28 of each gripper assembly 24 and 26 are disposed in a common plane. As seen in FIGS. 1 and 3, the frame members 34 are supported relative to control head 14 by support rods 36 in adjusting collars 38 so that the position of the frame members 34 can be adjusted vertically relative to the control head 14 and relative to each other. Horizontal adjustment of the collars 38 also is provided in a well known manner but is not illustrated in detail, by which the belts 28 can be adjusted laterally to contact the opposite sides of containers.

The drive pulleys 30 of the gripper belts 24 and 26 at each side of the conveyer 20 are each driven by a common drive shaft assembly 42 incorporating universal joints coupled to a drive pulley 44 best seen in FIG. 3 and located in the control housing 14. As seen in FIG. 6, the two drive pulleys 44 are driven by a common motor 45. The motor 45 is a 90 volt direct current motor of variable speed having and a drive belt 48 trained over pulleys 44 so that opposed surfaces of belt 48 engage the pair of pulleys 44. As a result the pulleys 44 travel in opposite directions so that adjacent flights of the container gripping belts 28 associated with opposite sides of containers on conveyor 20 travel in the same direction and are regulated to travel at the same speed as the conveyer 20. The belts 28 serve to hold the containers erect and to prevent rotation, particularly when the cap is being applied to a closed position.

Figure 7:
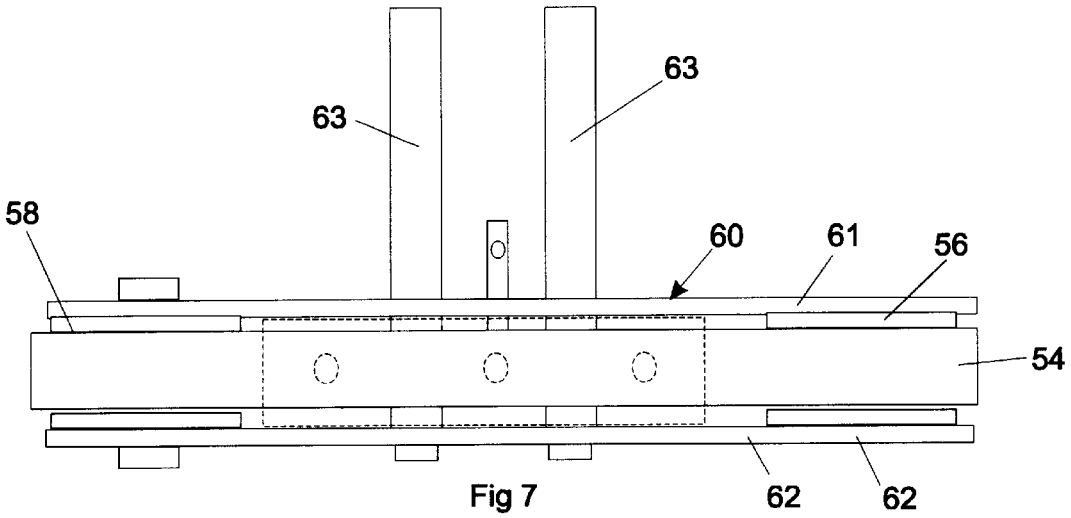
FIG. 7 is a front elevation of a portion of the capping apparatus seen in FIG. 3.
Figure 8:
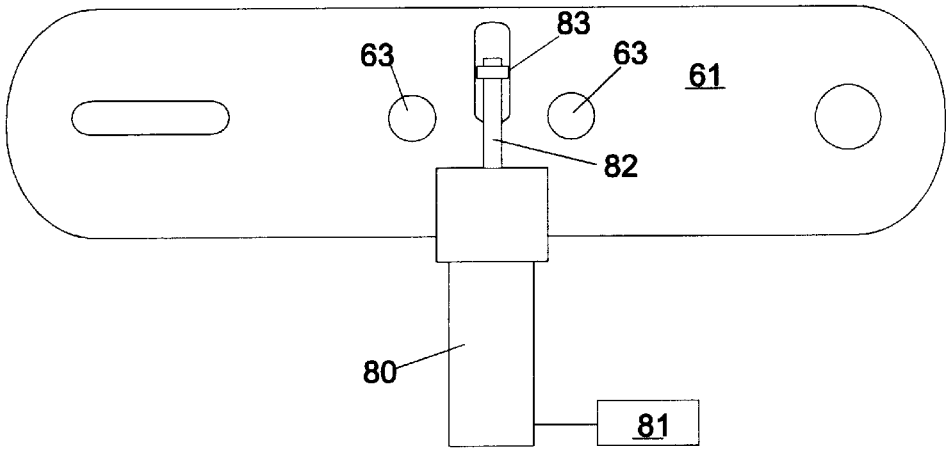
FIG. 8 is a plan view of a portion of the structure seen in FIG. 7.

For the purpose of rotating threaded caps to a closed and sealed position on containers being transported by the conveyer 20 and container gripping means 22, a cap gripper assembly designated generally at 50 is provided. The cap gripper assembly 50 includes a pair of cap engaging belts 54 disposed at opposite sides of the container conveying belt 20. Each of the belts 54 are trained over a drive pulley 56 and an idler pulley 58 supported on a pair of mounting frames 60 as seen in FIG. 7. The mounting frames 60 are mirror images of each other and each includes an upper plate 61 and lower plate 62 supported in spaced apart relation to each other and from the head 14 by a pair of support rods 63. The drive pulley 56 and an idler pulley 58 are disposed between and at opposite ends of the plates 61 and 62 and the cap engaging belts 54 are trained over the pulleys 56, 58 on a pair of mounting frames 60 as seen in FIG. 7. The frames 60 supporting cap engaging belts 54 can be adjusted vertically by adjusting the position of support rods 63 in collars 64 seen in FIG. 3. Lateral adjustment to accommodate different diameters of caps can be accomplished by selectively positioning the collars 64 relative to head 14.

The relative position of the conveying belt 20 and capper assembly 50 to containers and caps are best seen in FIGS. 1 and 2 showing a single container 51 and a cap 52 as they pass through the filling and capping machine 10.

Each of the drive pulleys 56 for the pair of belts 54 is driven by a drive shaft assembly 66 including universal joints and having a pulley 68 located in the control head 14. As seen in FIG. 6, the two pulleys 68 are driven by the same side of a common belt 70 so that the belts 54 are rotated in the same direction as viewed in plan in FIGS. 4 and 5. As a result, the inboard flight 71 of each of the belts 54 at opposed sides of the path of the caps, travel in opposite directions relative to each other as indicated by arrows 72 so that when engaged with the opposite sides of a threaded cap 52 they impart clockwise rotational motion tending to close the caps 52 on their associated container 51.

Figure 4:
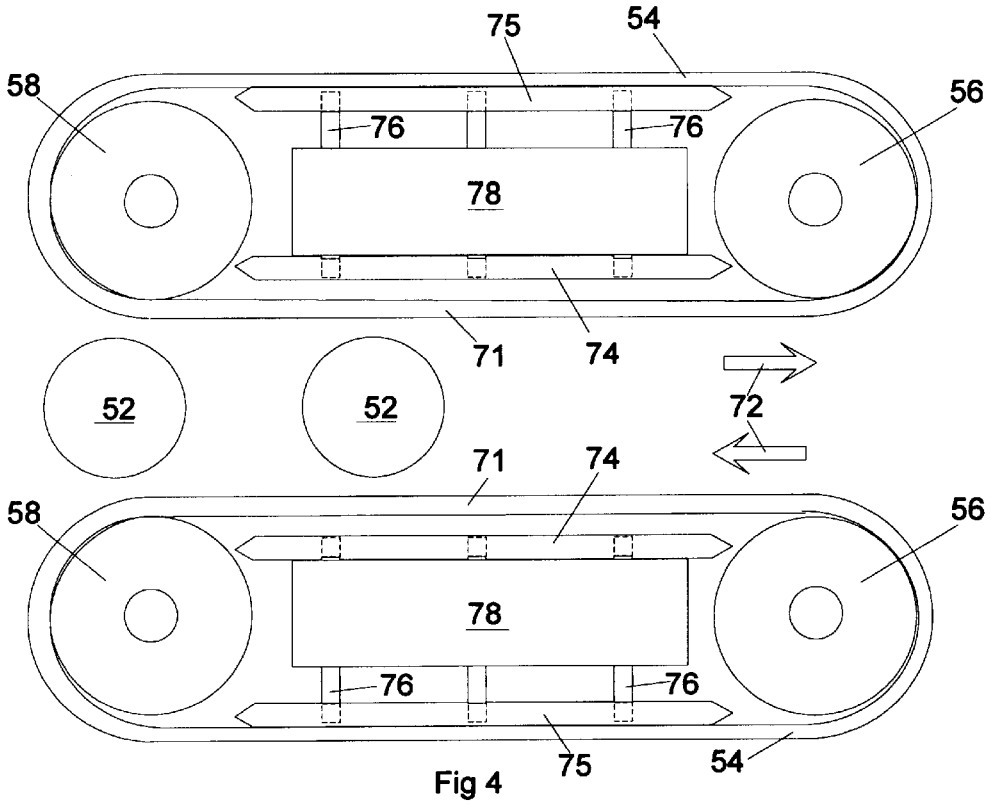
FIG. 4 is a top plan view at an enlarged scale of the cap applying mechanism showing one condition of operation.
Figure 5:
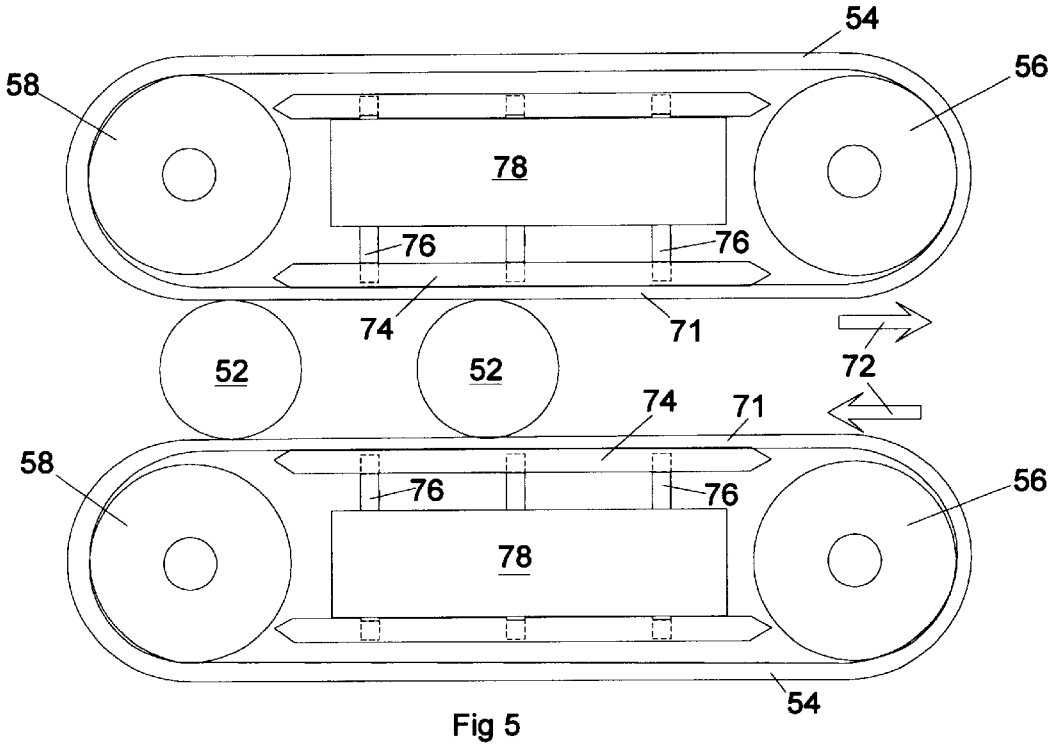
FIG. 5 is a view similar to FIG. 4 showing another condition of operation.

Associated with each of the two belts 54 is a load shoe assembly 73. As seen in FIGS. 4 and 5, the load shoe assemblies 73 each include a load plate or shoe 74 and a stop plate or shoe 75 joined together by three support rods 76. The support rods 76 are slidably mounted in a mounting block 78 fixed between the plates 61 and 62 seen in FIG. 7. The load shoes 74 are movable into engagement with the inside surfaces of the belts 54 (as seen in FIG. 5) opposite to the cap engaging surface of the belt for a substantial portion of the belt flight 71 between the drive pulley 56 and idler pulley 58. The stop shoes 75 engaged the mounting block 78 to limit the stroke of the load shoes 74 in one direction and the belt engaging shoes 74 engage blocks 78 to limit the stroke of the stop shoes 75 in the opposite direction. Each load shoe 74 is supported relative to the associated support frame 60 for sliding movement toward and away from the associated cap engaging flight 71 of the belts 54. In operation, the load shoes 74 are reciprocated towards each other as seen in FIG. 5 to increase cap engaging pressure of the belts 54 and are reciprocated away from each other as seen in FIG. 4 to engage the return flights 79 of the belts 54 to move the cap engaging flights 71 away from caps 52 to decrease or eliminate cap engaging pressure. Such reciprocation of the load shoe assembly 73 is accomplish at a high rate of speed by double acting pneumatic cylinders 80 under the control of a solenoid actuated air valve 81. An output rod 82 of cylinder 80 is connected by a tang 83 to an intermediate one of the extending support rods 76 between load shoe 74,and stop shoe 75 to transmit such reciprocating motion.

As seen in FIGS. 3 and 6, the belts 54 are driven in unison from a motor 84 in the form of a 90 volt direct current electric motor using a belt 85 to drive an air clutch 86 having its output pulley 87 connected to the drive belt 70. By controlling the air pressure, the maximum gripping force of the opposed pair of capping belts 54 is regulated so that if a predetermined gripping force is exceeded, the clutch 86 will slip and interrupt the drive.

In operation, containers 54 are filled and advanced on the elongated conveyer 20 to the cap gripper or capping machine 50. At the capping machine, the filled containers are gripped on opposite sides by opposed container gripping belts 22, 24 having a linear speed and direction the same as that of the conveyer belt 20.

Caps 52 are delivered in a conventional manner by an inclined chute 88 as seen in FIG. 2 and are released from the chute 88 upon contact with the containers to rest on the top of the container neck and to be pressed downwardly by a shoe 89 in readiness for rotation to a closed condition. In this position of rest, the caps pass between the capper belts 54. Upon movement of the load shoes 74 (FIG. 5) towards each other, the belts 54 press against the sides of caps 52. Because of the opposing travel of the belt flights 71, movement is transferred from the belts to twist the caps 52 and screw them to a closed position. For the purpose of increasing gripping friction, the belts 54 can have a tacky or soft outer surface.

Each of the times that the pair of belts 54 press against the sides of the caps is minute and complete rotation of a cap 52 to a fully closed and sealed position requires two or more contacts of the belts 54 with the cap. This time of contact is referred to as dwell time. The time that the belts 54 are out of contact with the container is referred to as release time. Both of these times, which make up a cycle, are separately adjustable and controlled as is the number of cycles required of each container and cap. By way of example three cycles might be required for a single cap to a fully closed position. It should be understood, however, that more than one cap can be twisted in a closing direction during any single cycle of the belts 54.

In addition to the belts 54, the clutch 86 is engaged to transmit driving motion to the capping belts 54. If the torque on the cap exceeds some predetermined limit selected by the operator, the clutch 86 is released. A typical release pressure for the clutch 86 could be 20 psi. The many variations in friction, materials, and operating conditions can be accommodated by the microprocessor control system 90 positioned in the control head 14.

Figure 9:
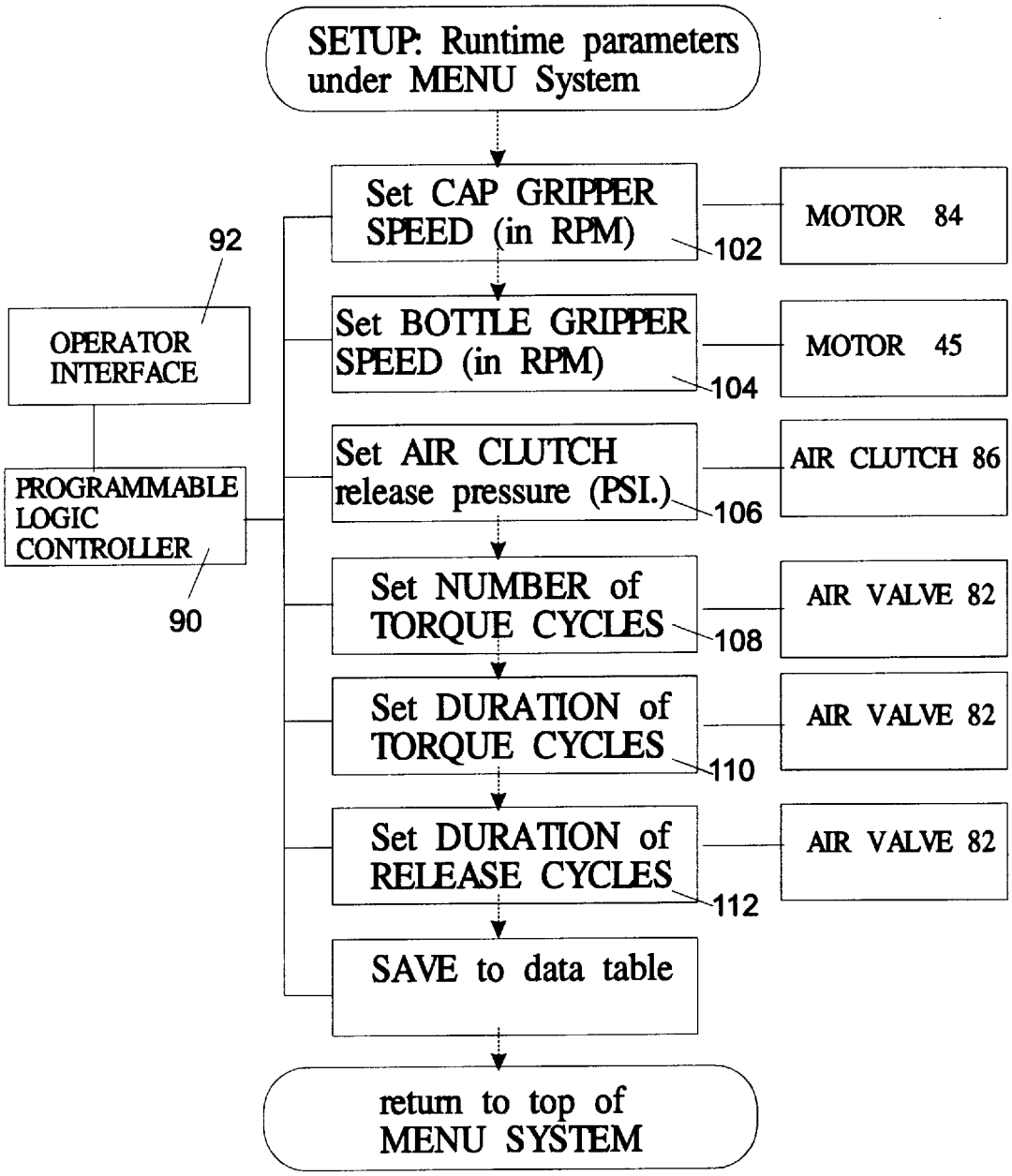
FIG. 9 is a flow diagram of the operation of the microprocessing controls.

Referring to FIG. 9, the controller system includes a programmable logic controller 90 having an operator interface 92. The controller 90 has a number of programs with various parameters making it possible to cap containers of different sizes and configurations with various products having different properties. The speed and position of the container gripping means 22, the speed of the cap gripping means 50, the maximum torque applied to the caps 52, the frequency of engagement movement of the cap gripping belts 54, including the times of engagement and disengagement, all are variably controlled from the controller 90 without any mechanical adjustment being required. Once mechanical adjustments are made to select the relative positions of the container engaging belts 28 relative to each other and to the container conveying belt 20, and the relative position of the cap gripping belts 54 relative to the container engaging belts 28, the use of the programmable logic controller 90 permits regulation of the electric portion of the system by selection of speeds of the motors 45 and 84 and regulation of the pneumatic portion of the system by selection of air pressures to the clutch 86 and the delivery of air to the reciprocating air motor 80 which oscillates the belt engaging shoes 74 and 75.

Regulation of the various parameters is illustrated in FIG. 9. The speed of the cap gripper 50 is selected in RPMs and entered at 102 to regulate the motor 84 and speed of the container or bottle gripper 22 in RPMs is entered at 104 to regulate the speed of motor 45. The release pressure of the air clutch 86 in pounds per square inch is entered at 106. The number of cap engaging torque cycles, the duration of such torque cycles and the duration of the release cycles is entered at 108, 110 and 112, respectively to regulate solenoid valve 82. With the various parameters entered, the filling capping machine 10 is in readiness for operation. Once the speed of container conveyer belt 20 has been established, the container gripper speed can be selected to match the container conveyer belt speed. This will determine the output speed of the entire line. To accomplish the desired degree of cap tightening, the loading on the air clutch is selected as well as the drive speeds of the capper belts. Based on the capper belts speeds, the dwell and release time of the shoes is selected to establish the various parameters of operation of the capping machine.

A capping and filling machine has been provided in which caps are applied to containers at a relatively high rate of speed by belts which contact opposite side of the cap to import impulses of torque to twist the cap to a fully closed position. The frequency of application of torque, the maximum torque and the speed of movement of containers and caps are all regulated by a programmable logic controller.

I claim:

1. A machine for attaching caps to containers supported on a conveyer for movement in a longitudinal path, said caps initially resting on the top of said container in an open position, said machine comprising:

a head supported above said path of said container, a pair of endless belts supported from said head at opposite sides of said longitudinal path for simultaneous movement in a common plane passing through said caps, each of said belts having a flight portion adjacent to said caps, means for continuously moving said belts simultaneously so that said flight portions of said belts travel in opposite directions to each other in proximity to said caps, a pair of shoes disposed at opposite sides of said path adjacent said flight portions, respectively, for reciprocating movement toward said caps to press said flight portions of said belts into engagement with said caps and away from said caps for disengagement of said flight portions of said belt from said caps, and means for cyclically moving said shoes towards each other for predetermined periods of time to press said belts against said caps to impart turning movement and closing of said caps on said containers and away from each other for each cap as the containers move along said conveyor.

2. The combination of claim 1 wherein said means for moving said belt include selectively variable clutch means for limiting the maximum amount of turning movement on said caps.

3. The combination of claim 1 wherein said head is supported for vertical adjustment relative to said path to said container.

4. The combination of claim 1 wherein said means for moving said endless belt comprises a common drive for both of said belts.

5. The combination of claim 4 wherein said common drive is a drive belt trained over drive pulleys connected to said pair of belts, respectively.

6. The combination of claim 5 wherein said drive belt has opposed drive surfaces at opposite sides of said drive belt in engagement with said pair of drive pulleys for movement of said flights of said belts in opposite directions.

7. The combination of claim 1 and further comprising a second pair of endless belts disposed at opposite sides of said longitudinal path for movement in a common plane passing through said containers, each of the said belts having a flight portion in engagement with said containers and means for continuously moving said belts simultaneously so that said flight portions travel in the same direction and in engagement with said containers to hold them against rotation during movement on said conveyer.

8. The combination of claim 1 and further comprising an additional pair of shoes connected to the first mentioned pair of said shoes, respectively, for simultaneous movement therewith for engagement with said belts to move said flight portions of said belts away from said caps.

9. The combination of claim 8 wherein said pairs of shoes are reciprocated continuously during movement of said containers on said conveyor.

10. The combination of claim 9 and further comprising a support member for said pairs of shoes and wherein said additional pair of shoes engages said support member to limit the travel of said first mentioned pair of shoes toward said belts and said first mentioned pair of shoes engages said support member to limit the travel of said additional pair of shoes toward said belts.

11. Apparatus for rotating caps on containers comprising:

a conveyer for advancing containers in a predetermined path, each of said containers having a cap resting thereon, a pair of endless belts positioned at opposite sides of said path and each trained over a pair of pulleys having vertical axes of rotation with adjacent flights of said belts being disposed at opposite sides of said path and in vertical alignment with said cap, means for rotating said belts so that adjacent flights of said belt move in opposite directions, a pair of shoes engageable with said adjacent flights to move said flights toward each other and into engagement with said cap, and means for cyclically moving said shoes into engagement with said belts for predetermined periods of time whereby said belts rotate said caps onto said containers and away from said belts for each cap as said containers move on said conveyer.

12. The combination of claim 11 wherein said belts are moved simultaneously toward and away from each other.

13. The combination of claim 11 and further comprising means for oscillating said shoe means continuously at a predetermined frequency.

14. The combination of claim 13 wherein said means for oscillating said shoe means includes an air cylinder.

* * * * *